US007149465B2

(12) United States Patent
Amemiya et al.

(10) Patent No.: US 7,149,465 B2
(45) Date of Patent: Dec. 12, 2006

(54) CLEANING UNIT, PROCESS CARTRIDGE, IMAGE FORMING APPARATUS, AND TONER

(75) Inventors: Ken Amemiya, Tokyo (JP); Masato Yanagida, Tokyo (JP); Naohiro Kumagai, Kanagawa (JP); Takeshi Shintani, Kanagawa (JP); Takaaki Tawada, Kanagawa (JP); Yuji Arai, Kanagawa (JP); Toshio Koike, Kanagawa (JP); Takuji Yoneda, Tokyo (JP); Takeshi Tabuchi, Saitama (JP); Yutaka Takahashi, Tokyo (JP); Eisaku Murakami, Tokyo (JP); Takeshi Uchitani, Kanagawa (JP); Masami Tomita, Shizuoka (JP); Masanori Kawasumi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 99 days.

(21) Appl. No.: 10/921,993

(22) Filed: Aug. 20, 2004

(65) Prior Publication Data

US 2005/0074264 A1 Apr. 7, 2005

(30) Foreign Application Priority Data

Aug. 20, 2003 (JP) ..... 2003-295831

(51) Int. Cl.
*G03G 21/00* (2006.01)

(52) U.S. Cl. ..... 399/346; 399/123; 399/302; 399/349; 399/353

(58) Field of Classification Search ..... 399/111, 399/349, 346, 353, 350, 123, 302
See application file for complete search history.

(56) References Cited

U.S. PATENT DOCUMENTS 5,164,774 A * 11/1992 Tomita et al. ..... 399/284
5,486,909 A 1/1996 Takenaka et al.
5,489,747 A 2/1996 Takenaka et al.
5,596,395 A 1/1997 Sawamura et al.
5,610,691 A 3/1997 Takahashi et al.
5,617,191 A 4/1997 Murakami et al.

(Continued)

FOREIGN PATENT DOCUMENTS

JP 1-112253 4/1989

(Continued)

OTHER PUBLICATIONS

U.S. Appl. No. 11/207,819, filed Aug. 22, 2005, Shintani et al.

*Primary Examiner*—David M. Gray
*Assistant Examiner*—Geoffrey T Evans
(74) *Attorney, Agent, or Firm*—Oblon, Spivak, McClelland, Maier & Neustadt, P.C.

(57) ABSTRACT

A cleaning unit includes a cleaning blade that cleans toner on an image carrier and a brush-shaped roller that applies a lubricant of a molded lubricant on the image carrier. The brush-shaped roller is insulative, and delivers the toner cleaned by the cleaning blade to inside of the cleaning unit.

22 Claims, 5 Drawing Sheets

U.S. PATENT DOCUMENTS 5,625,439 A 4/1997 Murakami
5,625,440 A 4/1997 Matsumae et al.
5,649,265 A 7/1997 Tabuchi
5,666,625 A 9/1997 Komatsubara et al.
5,689,782 A 11/1997 Murakami et al.
5,697,026 A 12/1997 Matsumae et al.
5,716,748 A * 2/1998 Hasegawa et al. ..... 430/111.2
5,721,083 A 2/1998 Masuda et al.
5,734,952 A 3/1998 Murakami et al.
5,761,594 A 6/1998 Seto et al.
5,768,665 A 6/1998 Yamanaka et al.
5,781,831 A * 7/1998 Matsuzaki et al. ..... 399/119
5,792,533 A 8/1998 Kurokawa et al.
5,826,144 A 10/1998 Takenaka et al.
5,840,456 A 11/1998 Tomita et al.
5,851,716 A 12/1998 Kuramoto et al.
5,879,752 A 3/1999 Murakami et al.
5,881,339 A 3/1999 Yanagida et al.
5,887,224 A 3/1999 Mizuishi et al.
5,897,243 A 4/1999 Komatsubara et al.
5,915,143 A 6/1999 Watanabe et al.
5,970,282 A 10/1999 Yanagida et al.
5,975,446 A 11/1999 Yaguchi et al.
5,995,789 A 11/1999 Murakami et al.
6,006,050 A 12/1999 Watanabe et al.
6,023,342 A 2/2000 Yanagida
6,032,006 A 2/2000 Yanagida
6,055,388 A 4/2000 Watanabe et al.
6,072,977 A 6/2000 Murakami
6,074,794 A 6/2000 Fushimi et al.
6,085,062 A 7/2000 Mizuishi et al.
6,103,441 A 8/2000 Tomita et al.
6,128,449 A 10/2000 Zenba et al.
6,144,811 A 11/2000 Ohori et al.
6,144,822 A 11/2000 Yamaguchi et al.
6,148,161 A 11/2000 Usui et al.
6,160,969 A 12/2000 Ishigaki et al.
6,226,481 B1 5/2001 Yoneda et al.
6,266,501 B1 7/2001 Mizuishi et al.
6,269,228 B1 7/2001 Kayahara et al.
6,363,229 B1 3/2002 Shiraishi et al.
6,405,006 B1 6/2002 Tabuchi
6,420,080 B1 * 7/2002 Nakamura et al. ..... 430/125
6,505,024 B1 1/2003 Kayahara et al.
6,539,189 B1 3/2003 Yanagida
6,597,881 B1 7/2003 Hatori et al.
6,615,013 B1 9/2003 Arai et al.
6,628,903 B1 9/2003 Ohori et al.
6,628,912 B1 9/2003 Amemiya et al.
6,640,076 B1 10/2003 Shintani
6,654,574 B1 11/2003 Kayahara et al.
6,660,443 B1 12/2003 Sugiyama et al.
6,665,512 B1 12/2003 Yanagida et al.
6,682,866 B1 1/2004 Sugiyama et al.
6,701,118 B1 3/2004 Kayahara et al.
6,740,460 B1 5/2004 Tomita et al.
6,756,175 B1 6/2004 Emoto et al.
6,757,505 B1 6/2004 Amemiya et al.
6,922,543 B1 * 7/2005 Kanagawa ..... 399/350
2001/0022910 A1 * 9/2001 Sawayama ..... 399/353
2001/0031411 A1 * 10/2001 Kojima et al. ..... 430/58.05
2001/0031414 A1 * 10/2001 Yoshida et al. ..... 430/108.3
2002/0039506 A1 * 4/2002 Suzuki ..... 399/350
2003/0138717 A1 * 7/2003 Yagi et al. ..... 430/110.4

FOREIGN PATENT DOCUMENTS

JP 2-284158 11/1990
JP 3-181952 8/1991
JP 4-162048 6/1992
JP 5-72808 3/1993
JP 9-15902 1/1997
JP 11-133668 5/1999
JP 11-184340 7/1999
JP 2003-140518 5/2003

* cited by examiner

CLEANING UNIT, PROCESS CARTRIDGE, IMAGE FORMING APPARATUS, AND TONER

CROSS-REFERENCE TO RELATED APPLICATIONS

The present document incorporates by reference the entire contents of Japanese priority document, 2003-295831 filed in Japan on Aug. 20, 2003.

BACKGROUND OF THE INVENTION

1) Field of the Invention

The present invention relates to a cleaning unit that cleans toner on an image carrier, a process cartridge that employs the cleaning unit, an image forming apparatus, and toner.

2) Description of the Related Art

A color image forming apparatus that employs an electrophotographic system is now widely used. Moreover, a high-definition of an image to be printed is desired in association with easy availability of digitalized images. In the study of higher resolution and gradation of images, further conglobation and granulation to finer particle diameter are under research for improvement of a toner that makes latent images visualized in order to form images with the high definition.

For example, several methods are proposed, in which conglobated ground-type toner having a specific particle diameter distribution is obtained (see, for example, Japanese Patent Application Laid-Open Publication No. 1989-112253, Japanese Patent Application Laid-Open Publication No. 1990-284158, Japanese Patent Application Laid-Open Publication No. 1991-181952, and Japanese Patent Application Laid-Open Publication No. 1992-162048), toner conglobated and granulated to smaller particle diameter by suspension polymerization is obtained (see, for example, Japanese Patent Application Laid-Open Publication No. 1993-72808), toner conglobated and granulated to finer particle diameter is obtained by mixing a binding resin and a colorant in a solvent that is not mixable with water, followed by dispersing the mixture in an aqueous solvent in the presence of a dispersion stabilizer (see, for example, Japanese Patent Application Laid-Open Publication No. 1997-15902), and toner conglobated and granulated to smaller particle diameter is obtained by mixing a binding resin containing a partially denatured resin and a colorant in an organic solvent and dispersing the mixture in an aqueous solvent, followed by polyaddition reaction of the denatured resin (see, for example, Japanese Patent Application Laid-Open Publication No. 1999-133668). With the use of the above type of toner, image quality and fluidity are improved.

The toner granulated to finer particle diameter and conglobated is suitable for obtaining images with the high definition because the toner is accurately transferred; however, the conglobated toner is easy to roll down. Therefore, the toner rolls between a cleaning blade and a photosensitive member in a cleaning unit, which makes cleaning difficult. This may result in causes of abnormal images such as background fog.

Accordingly, an electrophotographic image forming method, for example, is proposed. In the electrophotographic image forming method including a cleaning member that cleans, with an elastic rubber blade, residual toner on the photosensitive member after toner has been transferred to a recording material, the toner contains zinc stearate of not less than 0.01% and not more than 0.5% with respect to the toner weight, and the elastic rubber blade is essentially retained, on the side of the cleaning blade abutting on the photosensitive member, to a supporting member to fix the blade to the cleaning member (see, for example, Japanese Patent Application Laid-Open Publication No. 1999-184340). However, there is a disadvantage that when zinc stearate is added to the toner, the zinc stearate on the photosensitive member becomes nonuniform depending on conditions of images to be developed.

In addition, a cleaning unit provided with a brush-shaped roller that is arranged with abutment on an electrophotographic photosensitive member drum on more upstream side of rotational direction of the electrophotographic photosensitive member drum compared to the cleaning blade is proposed (see, for example, Japanese Patent Application Laid-Open Publication No. 2003-140518). In this cleaning unit, applying a lubricant over the photosensitive member with a conductive brush is disclosed. However, there is a disadvantage that the lubricant and toner adhere to the surface of the brush, which are hard to remove, resulting in decrease in applying performance of the lubricant.

SUMMARY OF THE INVENTION

It is an object of the present invention to solve at least the above problems in the conventional technology.

A cleaning unit according to one aspect of the present invention includes a cleaning blade that cleans toner on an image carrier and a brush-shaped roller that applies a lubricant of a molded lubricant on the image carrier. The brush-shaped roller is insulative, and delivers the toner cleaned by the cleaning blade to inside of the cleaning unit.

A process cartridge according to another aspect of the present invention includes an image carrier that carries a latent image and a cleaning unit that cleans toner on the image carrier. The process cartridge is detachably arranged in a main body of an image forming apparatus. The cleaning unit includes a cleaning blade, a brush-shaped roller, and a molded lubricant. The brush-shaped roller is insulative, applies a lubricant of the molded lubricant on the image carrier, and delivers the toner cleaned by the cleaning blade to inside of the cleaning unit.

An image forming apparatus according to still another aspect of the present invention includes an image carrier that carries a latent image, a charging unit that charges the image carrier by bringing a charging member to come in contact with or to come close to a surface of the image carrier, a latent-image forming unit that forms a latent image on the image carrier, a developing unit that develops the latent image by bringing toner to adhere to the latent image, a transfer unit that transfers the toner image formed on the image carrier to a recording medium moving tightly held between a surface of the image carrier and a surface moving member or to the surface moving member by forming a transfer electric field between the image carrier and the surface moving member that moves in contact with the surface of the image carrier, and a cleaning unit that cleans toner on the image carrier. The cleaning unit includes a cleaning blade, a brush-shaped roller, and a molded lubricant. The brush-shaped roller is insulative, applies a lubricant of the molded lubricant on the image carrier, and delivers the toner cleaned by the cleaning blade to inside of the cleaning unit.

A toner according to still another aspect of the present invention has a volume average particle diameter in a range of 3 micrometers to 8 micrometers and a degree of dispersion defined by a ratio of a volume average particle diameter to a number average particle diameter in a range of 1.00 to 1.40.

The other objects, features, and advantages of the present invention are specifically set forth in or will become apparent from the following detailed description of the invention when read in conjunction with the accompanying drawings.

DETAILED DESCRIPTION

Exemplary embodiments of a cleaning unit, a process cartridge, an image forming apparatus, and a toner according to the present invention will be explained in detail below with reference to the accompanying drawings. It is easy for those skilled in the art to carry out another embodiment after changes and correction of the present invention without departing from the scope of the claims, and those changes and correction are included in the scope of the present claims. The following description is one of the examples of the best mode of the present invention and does not limit the scope of the present claims.

Figure 1:
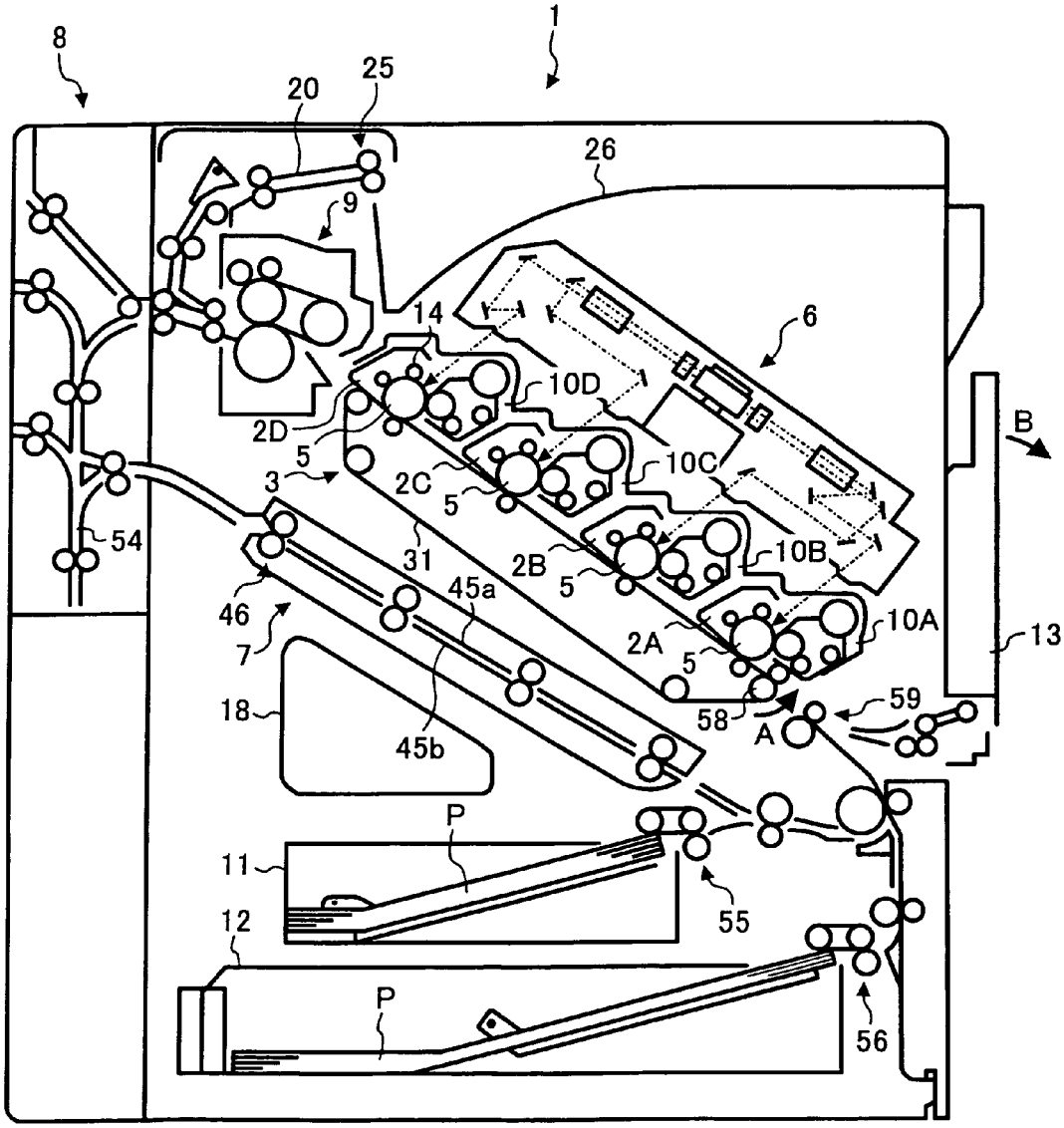
FIG. 1 is schematic of a small-scale full-color printer to which the present invention is applied.

FIG. 1 is schematic of a small-scale full-color printer to which the present invention is applied. In a main body of image forming apparatus 1 (hereinafter, "main body"), image forming units 2A, 2B, 2C, and 2D including four photosensitive members that are image carriers are detachably attached, respectively, to the main body 1. A transfer unit 3 in which a transfer belt 31 is attached rotatably in the direction shown by an arrow A among a plurality of rollers is arranged in the approximate center of the main body 1.

Each of the photosensitive members 5 provided to each of the image forming units 2A, 2B, 2C, and 2D is arranged so that the photosensitive members 5 are in contact with the upper surface of the transfer belt 31. Developing units 10A, 10B, 10C, and 10D each of which uses each different toner color are arranged correspondingly to the image forming units 2A, 2B, 2C, and 2D.

The structure of the image forming units 2A, 2B, 2C, and 2D is identical to one another. The image forming unit 2A forms images corresponding to magenta color, the image forming unit 2B forms images corresponding to cyan color, the image forming unit 2C forms images corresponding to yellow color, and the image forming unit 2D forms images corresponding to black color.

A writing unit 6 is arranged above the image forming units 2A, 2B, 2C, and 2D, and a duplex unit 7 is arranged below the transfer belt 31. This small printer is provided with a reversing unit 8 at the left hand of the main body 1, in which transfer paper is reversed to be delivered after image formation or is conveyed to the duplex unit 7.

The writing unit 6 is composed of four light sources of laser diode (LD) prepared for each different color, a set of polygon scanners including a hexagonal polygon mirror and a polygon motor, lenses such as fθ lens and long cylindrical lens, and a mirror arranged in each path of the light sources. Laser beams emitted from the laser diodes are polarized by the polygon scanners to be radiated on the photosensitive members 5.

The duplex unit 7 is composed of paired conveyor guide plates 45*a* and 45*b* and a plurality of paired conveyor rollers 46 (four sets in this example). At the time of duplex image formation mode that carries out image formation on both sides of transfer paper, the duplex unit 7 receives the transfer paper on which an image has been formed on one side, and which has been delivered to and switched back from a reverse paper delivery path 54 of the reversing unit 8, and delivers it toward a paper feeder.

The reversing unit 8 is composed of a plurality of paired conveyor rollers 46 and a plurality of paired conveyor guide plates 45. The reversing unit 8 reverses a piece of transfer paper at the time of duplex image formation to deliver it to the duplex unit 7, delivers the piece of transfer paper after image formation outside the apparatus as it is, or reverses the paper and delivers it outside the apparatus. In the paper feeder provided with paper feeding cassettes 11 and 12, sheet-separating feeders 55 and 56 that separate transfer paper piece by piece for feeding are provided, respectively.

A fixing device 9 that fixes an image on transfer paper onto which the image has been transferred is provided between the transfer belt 31 and the reversing unit 8. A reverse paper delivery path 20 is branched and formed downstream of the transfer paper delivery direction of the fixing device 9, and the transfer paper delivered there can be delivered onto a paper delivery tray 26 by paired paper delivery rollers 25.

Moreover, the paper feeding cassettes 11 and 12 that can house transfer paper in two different sizes are arranged at two levels in the lower portion of the main body 1. Furthermore, a manual paper feeding tray 13 is provided openably in the direction shown by an arrow B on the right side of the main body 1. By opening the manual paper feeding tray 13, paper can be manually fed.

Next, action in image formation of this image forming apparatus will be explained. When action of image formation is initiated, each photosensitive member rotates clockwise in FIG. 1. Then, the surfaces of each photosensitive member 5 are uniformly charged by a charging roller 141. By the writing'unit 6, laser beams corresponding to an image of magenta are irradiated onto the photosensitive member 5 of the image forming unit 2, laser beams corresponding to an image of cyan are irradiated onto the photosensitive member 5 of the image forming unit 2B, laser beams corresponding to an image of yellow are irradiated onto the photosensitive member 5 of the image forming unit 2C, and laser beams corresponding to an image of black are irradiated onto the photosensitive member 5 of the image forming unit 2D, thereby forming latent images'corresponding to image data of each color. When each latent image on each photosensitive member 5 reaches the developing unit 10A, 10B, 10C, or 10D, respectively, by rotation of the photosensitive member 5, it is developed with toner of magenta, cyan, yellow, or black to form their respective toner images in four colors.

On the other hand, a piece of transfer paper is fed by the sheet-separating feeder from the paper feeding cassette 11 or 12. The transfer paper is conveyed by paired resist rollers 59 provided immediately before the transfer belt 31 with exact timing with the toner images being formed on each photosensitive member 5. The transfer paper is charged positive by a paper charging roller 58 arranged near the entrance to the transfer belt 31. Accordingly, the transfer paper electrostatically sticks to the surface of the transfer belt 31. Then, while the transfer paper is conveyed with sticking to the transfer belt 31, each toner image of magenta color, cyan color, yellow color, or black color is transferred to the transfer paper in succession to form a full-color toner image in four-color registration. The toner image is fused and fixed by means of application of heat and pressure to the transfer paper by the fixing device 9. Then, through paper delivery systems according to specified modes, the transfer paper is reversely delivered to the paper delivery tray 26 provided in the upper portion of the main body 1, or is directly conveyed from the fixing unit 9 to be discharged straight through the inside of the reversing unit 8. When a duplex image formation mode is selected, the transfer paper is conveyed to the reverse delivery path inside the reversing unit 8 described earlier, and then switched back to be delivered to the duplex unit 7. Then the transfer paper is fed again to the image forming portion in which the image forming units 2A, 2B, 2C, and 2D are provided, and an image is formed on the back surface of the transfer paper, followed by discharging it.

On the other hand, each photosensitive member 5 continues to rotate as it does after separation from the transfer belt 31, and a brush-shaped roller 156 applies a lubricant scraped from a molded lubricant 157 over the photosensitive member 5.

In the subsequent image formation, the image forming process described above is repeated. A film of the lubricant to be formed over the photosensitive member 5 is very thin; therefore, charging by a charging unit 14 is not inhibited. Another toner image that is redeveloped on the photosensitive member 5 is transferred onto the transfer paper while sticking to the transfer belt 31.

Each of the developing units 10A, 10B, 10C, and 10D is composed of a developing roller opposite to the photosensitive member 5, a screw that delivers and agitates a developer, a toner concentration sensor, and the like. The developing roller is composed of a rotatable sleeve arranged outside and a magnet fixed inside. Toner is supplied from a toner supplying device according to outputs from the toner concentration sensor. In the present embodiment, a two-component developer composed of toner and a carrier is used as a developer.

The carrier composed of a core material itself or one that is provided with an applying layer over the core material is generally used.

The core material for the carrier of a resin applying layer that can be used for the present invention includes ferrite and magnetite. An appropriate particle diameter of this core substance is 20 micrometers to 65 micrometers, and preferably about 30 micrometers to 60 micrometers. Styrene resin, acrylic resin, fluororesin, silicone resin, or a mixture and a copolymer thereof may be used for the resin used for forming the carrier applying layer. As to a forming method of the applying layer, similarly to conventional methods, the applying layer may be formed by means such as spraying method and immersion method in which the surface of particles of the carrier core material is applied with the resin.

Figure 2:
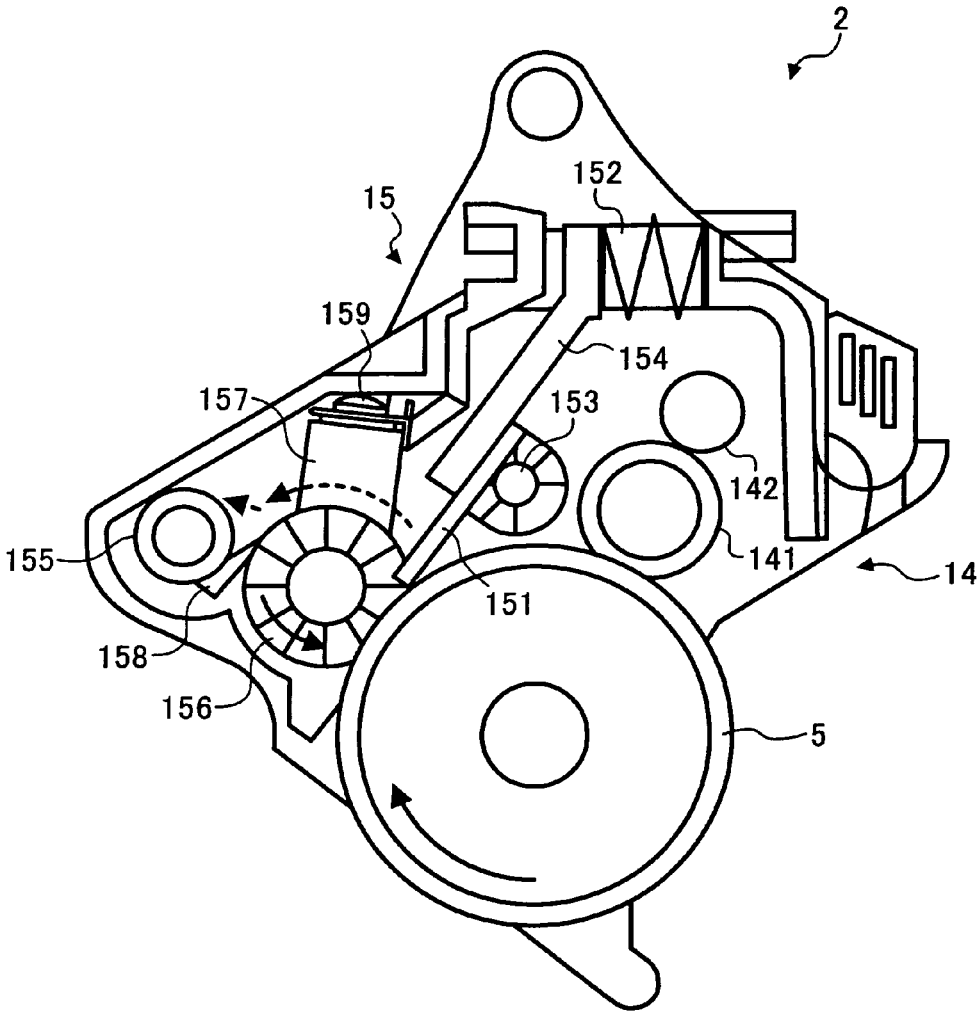
FIG. 2 is a schematic of an image forming unit.

FIG. 2 is a schematic of an image forming unit. As shown in FIG. 2, each of the image forming units 2A, 2B, 2C, and 2D is composed of the photosensitive member 5 on which an electrostatic latent image is formed, the charging unit 14 that charges the surface of the photosensitive member 5, and the cleaning unit 15 that cleans the surface of the photosensitive member 5.

The charging roller 141 of the charging unit 14 is dielectric or semi-dielectric and applies a voltage of any one of direct and alternating or both currents to give electric charge onto the photosensitive member 5 and charges the photosensitive member 5. On the charging roller 141 abuts a charging roller cleaning brush 142 that cleans the surface of the roller.

The cleaning unit 15 includes a cleaning blade 151 that cleans untransferred toner on the surface of the photosensitive member 5, a support member 154 that supports the cleaning blade 151, a pressure spring for blade 152 that adjusts an abutment pressure of the cleaning blade 151, a rotation support shaft 153 that is rotated by the abutment pressure of the cleaning blade 151, the brush-shaped roller 156 that applies a lubricant, the molded lubricant 157 that is made by molding a lubricant into a box shape, a brush-shaped roller scraper 158 that separates the toner adhering to the brush-shaped roller, and a pressure spring for bar 159 that adjusts a pressure of the molded lubricant 157 to be applied to the brush-shaped roller.

In addition, the cleaning unit 15 includes the brush-shaped roller 156 that comes in contact with the molded lubricant 157 and scrapes the lubricant to apply it over the surface of the photosensitive member 5, the brush-shaped roller scraper 158 that removes the toner adhering to the brush-shaped roller 156, and the pressure spring 159 that presses the molded lubricant 157 to the brush-shaped roller 156 with a predetermined pressure. For the molded lubricant 157, a lubricant that is processed into a bar by fusing and solidifying a metallic salt of fatty acid such as zinc stearate or a lubricant that is formed into a bar or a sheet by molding a fluororesin such as polytetrafluoroethylene can be used. The brush-shaped roller 156 has a shape that extends in the axis direction of the photosensitive member 5. The pressure spring 159 applies a force to the brush-shaped roller 156 such that almost all the molded lubricant 157 is used up. Since the molded lubricant 157 is a consumable, its thickness decreases with time. However, the molded lubricant 157 is pressed with a pressure by the pressure spring 159; therefore, the lubricant abuts on the brush-shaped roller 156 at all times, which allows the brush-shaped roller 156 to scrape the lubricant and then supply and apply it over the photosensitive member 5. Each lubricant is fixed and allowed to abut on the brush-shaped roller 156. When an amount of lubricant to be applied is adjusted, adjusting the pressure spring 159 that is a spring member makes it possible to adjust the applying amount to the photosensitive member 5.

At this time, the brush-shaped roller 156 is arranged so as to come in slidable contact with the cleaning blade 151. Owing to this arrangement, the cleaning blade 151 cleans the untransferred toner, and the toner collected at the edge of the cleaning blade 151 is scraped off by the brush-shaped roller 156 that applies the lubricant and moved to a toner conveying auger 155 by the brush-shaped roller 156. Then, the toner is brushed off the brush by the brush-shaped roller scraper 158 for separation, and the recovered waste toner is delivered to a waste toner housing portion not shown by rotation of the toner conveying auger 155.

For the cleaning unit 15, the toner cleaned by the cleaning blade 151 is used to be delivered by a brush or film that delivers the toner inside the cleaning unit 15; however, when the brush-shaped roller 156 that applies the lubricant and also serves as the brush or the film, the applying mechanism for lubricant can be arranged inside the cleaning unit 15, which can make the structure simple.

For the brush-shaped roller 156, a fiber selected from styrene resin, acrylic resin, polyester resin, fluororesin, and polyamide resin such as nylon can be used. In particular, a polyamide resin and a polyester resin that are hard-wearing are desirable, and it is preferred that these resins are not allowed to contain dielectric powder and are insulative as they are. Specifically, the electrical resistance is set to higher than $10^{12}$ Ω cm. When the fibers are dielectric, it is difficult even for the brush-shaped roller scraper 158 to separate the charged toner from the brush because the charged toner adheres to the brush by an image force. Making the brush insulative facilitates scraping the toner off the cleaning blade 151 and also separation of the toner by the brush-shaped roller scraper 158. This makes recovery of the cleaned toner faster and allows the cleaning blade 151 to clean stably. Moreover, after the toner is scraped by the brush-shaped roller 156, the roller scrapes the lubricant finely from the molded lubricant 157, and then uniformly applies the lubricant over the cleaning blade 151 or the photosensitive member 5, which makes it possible to suppress occurrence of cleaning failure and prevent the surface from becoming dirty.

The lubricant for the molded lubricant 157 includes, for example, metallic salts of fatty acids such as lead oleate, zinc oleate, copper oleate, zinc stearate, cobalt stearate, iron stearate, copper stearate, zinc palmitate, copper palmitate, and zinc linolenate, and fluororesins such as polytetrafluoroethylene, polychlorotrifluoroethylene, polyvinylidene fluoride, polytrifluorochloroethylene, dichlorodifluoroethylene, tetrafluoroethylene-ethylene copolymer, and tetrafluoroethylene-oxafluoropropylene copolymer. Particularly, metallic salts of stearic acid are preferable and zinc stearate is more preferable, because these are greatly effective in reducing friction of the photosensitive member 5.

Here, the molded lubricant 157 is pressed by the pressure spring 159 with not lower than 200 mN including its own weight of the pressure spring to the brush-shaped roller 156. As the pressure becomes higher, the amount of lubricant to be scraped from the molded lubricant 157 by the brush-shaped roller 156 increases. This leads to an increase in the amount of lubricant to be applied over the photosensitive member 5, resulting in a decrease of the friction coefficient of the photosensitive member 5.

Furthermore, the brush-shaped roller 156 is rotated in the same direction at the portion contacting the photosensitive member 5. By rotation of the brush-shaped roller in this direction, the lubricant adhering to the brush-shaped roller 156 can be supplied to the photosensitive member 5 without giving impact to it. When the lubricant is supplied to the photosensitive member 5 by the brush-shaped roller 156, formation of a film of lubricant is not necessary and, the lubricant supplied on the photosensitive member 5 forms a film of the lubricant with a pressing force of the cleaning blade 151. Accordingly, it is preferable here to rotate the brush-shaped roller in the same direction to supply the lubricant without giving impact to the photosensitive member 5. It is preferable that the peripheral velocity ratio between the brush-shaped roller 156 and the photosensitive member 5 (photosensitive member's peripheral velocity/brush-shaped roller's peripheral velocity) is within the range of 0.8 to 1.2. When the peripheral velocity ratio is smaller than 0.8, the supplying amount of the lubricant becomes small. When the ratio is over 1.2, the photosensitive member 5 may be damaged by impact, which may shorten the life of the photosensitive member 5. Still further, to supply the lubricant from the brush to the photosensitive member 5 with less impact, the ratio is more preferably within the range of 1.0 to 1.1.

By supplying the lubricant to the surface of the photosensitive member 5, a film of the lubricant is formed on the surface of the photosensitive member 5 and the friction coefficient is made 0.3 or smaller. The friction coefficient of the photosensitive member 5 is preferably set to not larger than 0.3, and further, more preferably not larger than 0.2. By setting the friction coefficient to not larger than 0.3, interaction between the photosensitive member 5 and the toner is reduced, and the toner on the photosensitive member 5 is easily removed, which can make the transfer rate enhanced. Further, an increase in friction between the cleaning blade 151 and the photosensitive member 5 is suppressed, resulting in enhancement of the cleaning effect. In particular, with the use of toner having a high spheroidicity, the toner is easy to roll on the photosensitive member 5; therefore, occurrence of cleaning failure can be suppressed. Furthermore, it is possible to suppress occurrence of cleaning failure due to a long time use by reducing the amount of toner to be cleaned with an increase in transfer rate. Still further, the friction coefficient is more preferably not larger than 0.2. On the other hand, when it becomes smaller than 0.1, the toner slips too much between the cleaning blade 151 and the photosensitive member 5. This causes occurrence of cleaning failure that the toner on the photosensitive member 5 slips through the cleaning blade 151.

Figure 3:
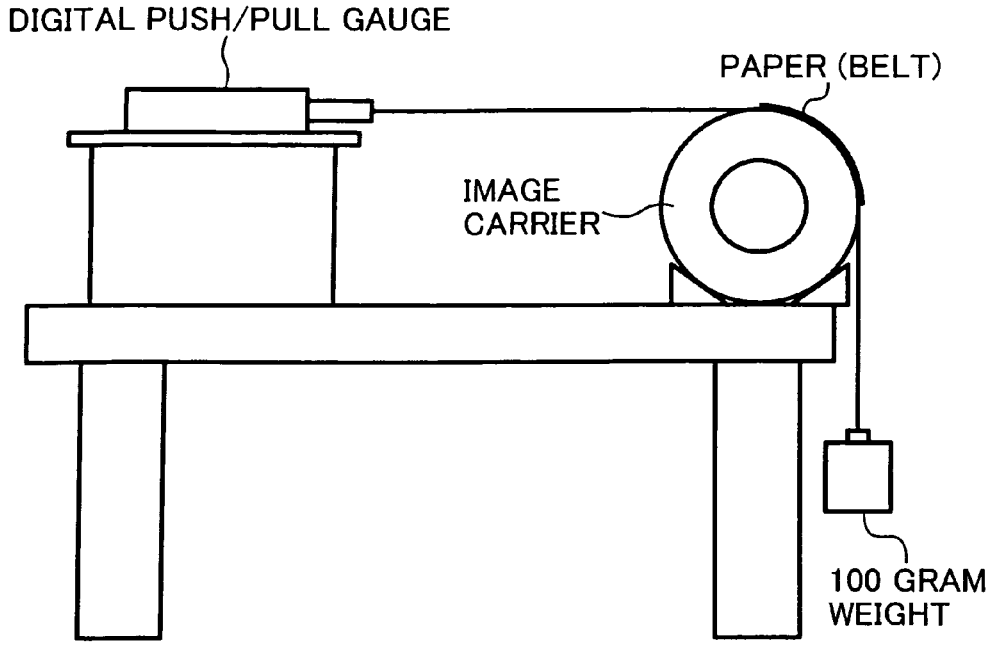
FIG. 3 is a schematic for illustrating a method of measuring a friction coefficient of a photosensitive member.

Here, the friction coefficient of the photosensitive member 5 is measured by Euler's belt method as follows. FIG. 3 is a schematic for illustrating a method of measuring a friction coefficient of a photosensitive member 5. In this case, with placing a paper-making trough in the longitudinal direction, paper of high quality and a medium thickness is laid as a belt over one-fourth of drum periphery of the photosensitive member, a load of, for example, 0.98 Newtons (100 grams) is hung on one side of the belt, a force gauge is arranged on the other side of the belt, and the force gauge is pulled. The load is read out when the belt moves. The load read out is substituted into the following equation to calculate the friction coefficient: Friction coefficient $\mu s=2/\pi \cdot \ln(F/0.98)$, where μ is coefficient of friction of rest and F is measurement value. The friction coefficient of the photosensitive member 5 in this image forming apparatus 1 means a value that has reached a stationary state during image formation. This means that the friction coefficients of the photosensitive member 5 are affected by other devices arranged in the image forming apparatus 1; therefore, changes occur from the value of friction coefficient immediately after image formation. However, the values of friction coefficient become approximately constant after image formation on about 1,000 sheets of recording paper in A4 size. Therefore, the friction coefficient here means a friction coefficient that becomes constant in this stationary state.

Figure 4:
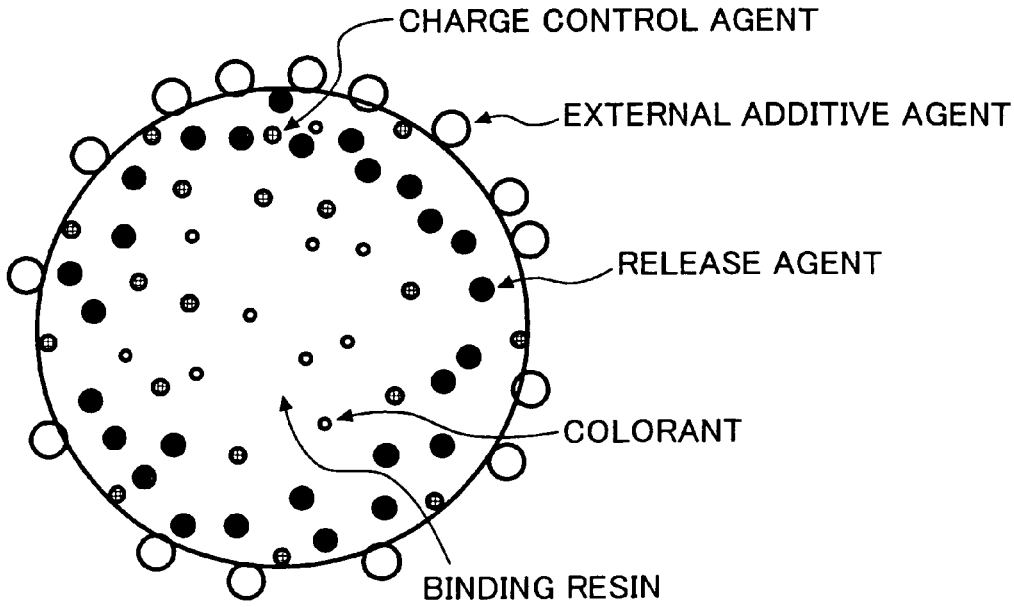
FIG. 4 is a schematic for illustrating a structure of toner.

FIG. 4 is a schematic for illustrating a structure of the toner. The toner is composed of at least a binding resin and a colorant, and a lubricant that reduces friction is externally added on the toner surface. Besides them, an electric charge control agent that controls an electrostatic property of toner, a release agent that enhances releasability from the fixing device, and the like may be contained, and an external additive that gives fluidity may be contained as well.

The binding resin includes polyester resin, vinyl resin, polyamide resin, epoxy resin, silicone resin, and the like, and particularly preferred is a vinyl resin. Specifically, a homopolymer of styrene and its substituted product such as polystyrene and polyvinyltoluene, and a copolymer such as styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-acrylonitrile copolymer, styrene-vinyl methyl ether copolymer, styrene-butadiene copolymer, and styrene-methyl methacrylate-butyl acrylate copolymer can be used.

For the colorant, any dye and pigment can be used. For example, carbon black, nigrosin dye, iron black, naphthol yellow S, hanza yellow (10G, 5G, G), cadmium yellow, yellow iron oxide, ocher, chrome yellow, titanium yellow, polyazo yellow, red iron oxide, minium, red lead, cadmium red, cadmium mercury red, antimony red, permanent red 4R, para red, fisee red, para-chloro-ortho-nitroaniline red, lithol fast scarlet G, brilliant fast scarlet, brilliant carmine BS, permanent red (F2R, F4R, FRL, FRLL, F4RH), fast scarlet VD, vulcanfast rubine B, brilliant scarlet G, lithol rubin GX, permanent red F5R, brilliant carmine 6B, pigment scarlet 3B, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, indigo, ultramarine blue, Prussian blue, anthraquinone blue, fast violet B, methyl violet lake, cobalt violet, manganese violet, dioxane violet, anthraquinone violet, chrome green, zinc green, pigment green B, naphthol green B, green gold, titanium oxide, zinc white, lithopone, and mixtures of the above can be used. The content of the colorant is usually 1% to 15%, and preferably 3% to 10%, with respect to the toner.

The electric charge control agent to be used includes, for example, salicylic acid compounds, nigrosin dyes, quaternary ammonium salt compounds, alkylpyridinium compounds and the like. The content is usually 0.1% to 5%, and preferably 1% to 3%, with respect to the toner.

The release agent to be used includes, for example, polyolefin waxes such as low molecular weight polyethylenes, low molecular weight polypropylenes, low molecular weight copolymers of polyethylene and polypropylene, ester waxes such as lower alcohol esters of fatty acids, higher alcohol esters of fatty acids, polyvalent alcohol esters of fatty acids, and amido waxes. The content is usually 0.5% to 10%, and preferably 1% to 5%, with respect to the toner.

As to the shape of the toner, its spheroidicity is preferably not lower than 0.93. The spheroidicity is defined by spheroidicity SR=(peripheral length of circle having the same area as projection area of particle/peripheral length of projection image of particle)×100%. As the shape of the toner is closer to a perfect sphere, the spheroidicity becomes a value closer to 100%. When such toner is used in conventional image forming apparatus, a case in which the toner cannot be sufficiently scraped off by abutment of a cleaning member such as the cleaning blade 151 raises. This is caused by the fact that the toner that becomes easy to roll on the photosensitive member 5. In this case, a possible measure to deal with this problem is that the cleaning blade 151 is allowed to abut on the photosensitive member 5 by a stronger force. However, this measure affects the rotation or movement accuracy of the photosensitive member 5, resulting in a cause of banding. In contrast, applying lubricant on the surface of the photosensitive member 5 for reducing the friction coefficient of the surface of the photosensitive member 5 leads to a reduction in burden of cleaning by the cleaning blade 151. This allows cleaning by the cleaning blade 151 without banding even if the cleaning blade 151 abuts on the photosensitive member 5 with a strong force.

This spheroidicity is adjusted by spheroidizing thermally and mechanically for toner produced by dry ground. Thermal spheroidizing can be carried out by, for example, spraying toner base particles with heat airflow using an atomizer and the like. Mechanical spheroidizing can be carried out by putting toner base particles together with a mixing medium such as glass having a low specific gravity into a mixer such as ball mill to agitate them. However, particles tend to flocculate to produce toner base particles with a larger particle diameter in thermal spheroidizing and fine powder is produced in mechanical spheroidizing, which requires another classifying process. In addition, the shape of toner produced in an aqueous solvent can be controlled by powerful agitation in a process of removing the solvent.

Furthermore, the toner may be added with a fluidity additive. The fluidity additive includes fine particles of metal oxide such as silica, titania, alumina, magnesia, zirconia, ferrite, and magnetite, and these metal oxide fine particles treated with a silane coupling agent, a titanate coupling agent, or zircoaluminate. Silica and titania that have been subjected to hydrophobic treatment with a coupling agent are preferable. Since the primary particle diameter of silica is small, a large effect is achieved by adding fluidity. Furthermore, titania can control the amount of toner charge. Combining those before adding to the toner is more preferable.

Still further, since a smaller volume average particle diameter Dv of toner can enhance thin line reproducibility, toner not larger than 8 micrometers at largest is used. However, when the particle diameter becomes smaller, degrees of development and cleaning becomes lower; therefore, the volume average particle diameter Dv of toner is preferably not smaller than 3 micrometers at smallest. Still further, when it is smaller than 3 micrometers, the amount of toner with a minute particle diameter that is hard to be developed increases on the surface of the carrier or the developing roller. This leads to insufficiency of contact and friction between other toner and the carrier or the developing roller, resulting in an increase of amount of toner of an opposite electrostatic property. This causes abnormal image formation such as background fog, which is not desirable.

The particle diameter distribution that is represented by ratio (Dv/Dn) between the volume average particle diameter Dv and the number average particle diameter Dn is preferably in the range of 1.00 to 1.40. By making the particle diameter distribution sharp, it is possible to make the distribution of amount of toner charge uniform. When the ratio of Dv/Dn exceeds 1.40, the distribution of amount of toner charge becomes wider. This results in difficulty in obtaining an image of high quality. The particle diameter of the toner is determined by measuring an average particle diameter of 50,000 particles using an aperture of 50 micrometers is selected for measurement corresponding to the particle diameter of the toner to be measured with the use of Coulter Counter Multisizer (product of Coulter Inc.)

Figure 5A:
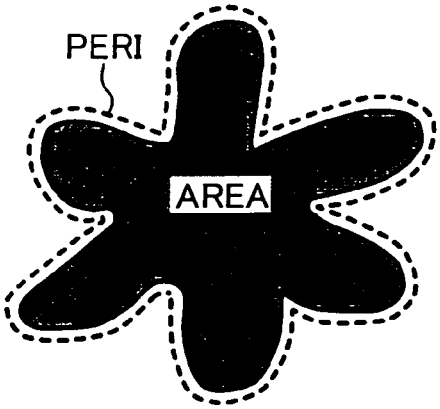
FIG. 5A is a schematic for illustrating a shape of the toner with a shape factor SF-1.
Figure 5B:
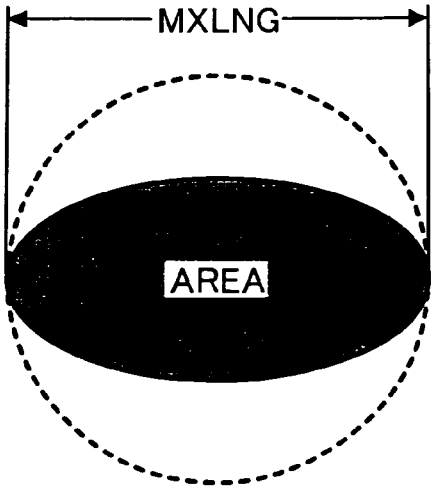
FIG. 5B is a schematic for illustrating a shape of the toner with a shape factor SF-2.

Moreover, a shape factor SF-1 of spheroidicity of the toner is preferably in the range of not smaller than 100 to not larger than 180, and a shape factor SF-2 is preferably in the range of not smaller than 100 to not larger than 180. FIG. 5A and FIG. 5B are schematics for illustrating shapes of the toner with a shape factor SF-1 and a shape factor SF-2, respectively. The shape factor SF-1 indicates a percentage of roundness of the toner shape and is represented by following equation (1). The value is resulted from the calculation that a maximum length MAXLNG of the shape that is formed by projection of the toner on a two-dimensional plane is squared and the result is divided by the figure area AREA, and then multiplied by 100π/4.

$$SF\text{-}1=\{(MXLNG)^2/\text{AREA}\}\cdot(100\pi/4) \quad (1)$$

When the value of SF-1 is 100, the shape of the toner is a perfect sphere. As the value of SF-1 becomes larger, the shape of the toner becomes a more irregular form.

Still further, the shape factor SF-2 indicates a percentage of projections and depressions of the toner shape and is represented by following equation (2). The value is resulted from the calculation that a peripheral length PERI of the figure that is formed by projection of the toner on a two-dimensional plane is squared and the result is divided by the figure area AREA, and then multiplied by 100π/4.

$$SF\text{-}2=\{(PERI)^2/\text{AREA}\}\cdot(100\pi/4) \quad (2)$$

When the value of SF-2 is 100, no projections and depressions exist on the toner surface. As the value of SF-2 becomes larger, the projections and depressions on the toner surface become more apparent.

As SF-1 and SF-2 become closer to 100, the toner on the photosensitive member 5 becomes easier to roll, which facilitate occurrence of a cleaning failure. However, making the friction coefficient of the photosensitive member 5 small can deal with this problem. When SF-1 and SF-2 exceed 180, the distribution of amount of toner charge becomes wider and the number of blurred letters and background fog increases, which makes image quality reduced. In addition to the above, the toner is easy to be affected by air resistance and the like at the time of development and transfer, which makes it difficult to move along the electric field. This results in reduction in reproducibility of images with high definition. It is preferred that SF-1 and SF-2 do not exceed 180.

The measurement of the shape factors is specifically carried out by means of taking photographs of the toner with a scanning electron microscope (S-800: product of Hitachi Ltd.) and introducing the photographs to an image analyzer (LUSEX3; product of Nireco Corp.) to analyze, followed by calculation.

Figure 6A:
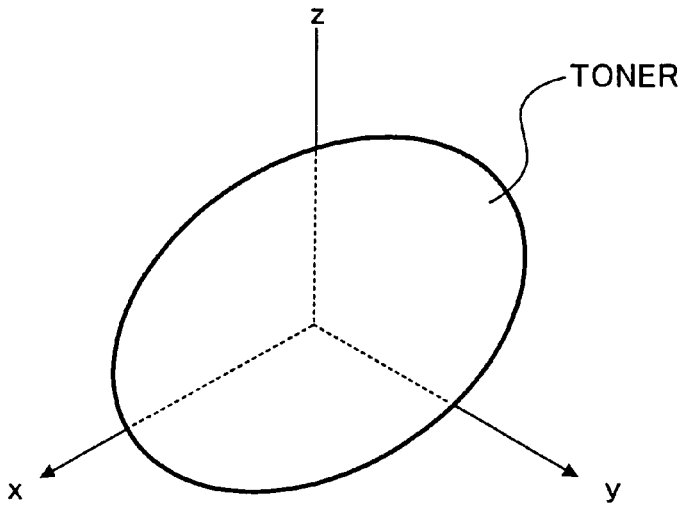
FIG. 6A is a schematic of an outer shape of the toner.
Figure 6B:
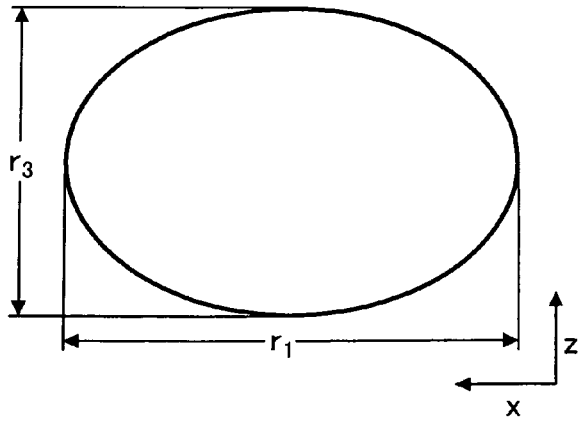
FIG. 6B is a cross section of the toner.
Figure 6C:
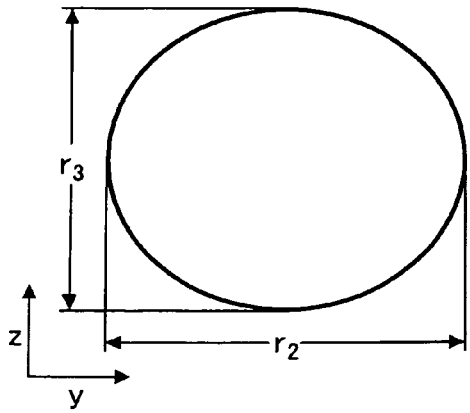
FIG. 6C is another cross section of the toner.

Still further, the toner used for this image forming apparatus may be approximately spherical. FIG. 6A is a schematic of an outer shape of the toner; and FIG. 6B is a cross section of the toner. The X axis represents a major axis r1 that is the longest axis of the toner, the Y axis represents a minor axis r2 that is the next longest axis, and the Z axis represents a thickness r3 of the shortest axis. Those have a relation of major axis r1≧minor axis r2≧thickness r3 to one another.

The toner has a shape that is approximately spherical with a ratio between the major axis and the minor axis (r2/r1) of 0.5 to 1.0 and a ratio between the thickness and the minor axis (r3/r2) of 0.7 to 1.0. When the ratio (r2/r1) between the major axis and the minor axis is smaller than 0.5, the shape of the toner becomes closer to an irregular form. Therefore, the distribution of amount of charge becomes wider.

When the ratio (r3/r2) between the thickness and the minor axis is smaller than 0.7, the shape of the toner becomes closer to an irregular form. Therefore, the distribution of amount of charge becomes wider. In particular, when the ratio between the thickness and the minor axis (r3/r2) is 1.0, the shape of the toner becomes approximately spherical, which leads to a narrower distribution of charge amount.

The size of the toner so far was measured with a scanning electron microscope (SEM) changing the visual angles and observing on the spot.

The shape of the toner can be controlled by production methods. For example, the surface of the toner produced by a dry ground method has projections and depressions, and its shape is in an indeterminate irregular form. Even though toner is produced by this dry ground method, the toner can be nearly made perfectly spherical through mechanical or thermal treatment. The surface of the toner produced by a method in which drops are formed by a suspension polymerization method or an emulsion polymerization method is smooth and the shape of the toner is often close to a perfect sphere. Further, the toner can be made elliptic by agitation in the middle of reaction in the solvent to give a shearing force.

Moreover, as the toner in such an approximately spherical shape, toner components that include a polyester prepolymer having functional groups containing nitrogen, a polyester, a colorant, and a release agent are subjected to any one of crosslinking reaction and elongation reaction or both in an aqueous medium under the presence of fine resin particles is preferable.

Polyesters are obtained by polycondensation reaction between polyvalent alcohol compounds and polyvalent carboxylic acid compounds.

The polyvalent alcohol compounds (PO) include dihydric alcohols (DIO) and polyhydric alcohols (TO) that are at least trivalent, and DIO alone or a mixture of DIO and a small amount of TO is preferred. The dihydric alcohols (DIO) include alkylene glycols (ethylene glycol, 1,2-propylene glycol, 1,3-propylene glycol, 1,4-butane diol, 1,6 hexane diol, etc.); alkylene ether glycols (diethylene glycol, triethylene glycol, dipropylene glycol, polyethylene glycol, polypropylene glycol, polytetramethylene ether glycol, etc.); alicyclic diols (1,4-cyclohexanedimethanol, hydrogenated bisphenol A, etc.); bisphenol compounds (bisphenol A, bisphenol F, bisphenol S, etc.); adducts of alkylene oxide (ethylene oxide, propylene oxide, butylene oxide, etc.) to the above alicyclic diol; and adducts of alkylene oxide (ethylene oxide, propylene oxide, butylene oxide, etc.) to the above bisphenol compounds. Preferred compounds among them are alkylene glycols of 2 carbon atoms to 12 carbon atoms and alkylene oxide adducts of bisphenol compounds. Particularly preferred are alkylene oxide adducts of bisphenol compounds and their combined use with alkylene glycol of 2 carbon atoms to 12 carbon atoms. The polyvalent alcohols (TO) that are at least trivalent include polyhydric aliphatic alcohols that are tri- to octavalent at least (glycerin, trimethylolethane, trimethylolpropane, pentaerythritol, sorbitol, etc.); phenol compounds that are at least trivalent (trisphenol PA, phenol novolac, cresol novolac, etc.); alkylene oxide adducts of the above polyphenol compounds that are at least trivalent, and the like.

The polyvalent carboxylic acids (PC) include dicarboxylic acids (DIC) and polyvalent carboxylic acids with at least trivalency, and DIC alone or a mixture of DIC and a small amount of TC is preferred. The dicarboxylic acids (DIC) include alkylene dicarboxylic acids (succinic acid, adipic acid, sebacic acid, etc.); alkenylene dicarboxylic acids (maleic acid, fumaric acid, etc.); aromatic dicarboxylic acids (phthalic acid, isophthalic acid, terephthalic acid, naphthalene dicarboxylic acid, etc.); and the like. Preferred compound among them are alkenylene dicarboxylic acids of 4 carbon atoms to 20 carbon atoms and aromatic dicarboxylic acids of 8 carbon atoms to 20 carbon atoms. The polyvalent carboxylic acids (TC) that are at least trivalent include aromatic polyvalent carboxylic acids of 9 carbon atoms to 20 carbon atoms (trimellitic acid, pyromellitic acid, etc.), and the like. As for polyvalent carboxylic acids (PC), the acid anhydrides or lower alkyl esters (methyl ester, ethyl ester, isopropyl ester, etc.) of the above compounds may be reacted with polyvalent alcohols (PO).

The ratio between polyvalent alcohol (PO) and polyvalent carboxylic acid (PC) is usually 2/1 to 1/1, preferably 1.5/1 to 1/1, and more preferably 1.3/1 to 1.02/1 as an equivalence ratio of [OH]/[COOH] between hydroxyl group [OH] and carboxyl group [COOH].

The polycondensation reaction between a polyvalent alcohol (PO) and a polyvalent carboxylic acid (PC) is carried out by heating to 150° C. to 280° C. in the presence of a known catalyst for esterification such as tetrabutoxytitanate or dibutyltin oxide and distilling off generated water under a reduced pressure as necessary to obtain polyester having hydroxyl groups. The hydroxyl group value of the polyester is preferably 5 or more, and the acid value of the polyester is usually 1 to 30, and preferably 5 to 20. By having acid value, the toner is easy to be negatively charged, and further, an affinity between the recording paper and the toner is excellent, resulting in enhancement of fixability at low temperature at the time of fixation to the recording paper. However, there is a worsening tendency in stability of electrostatic charge, particularly against environmental changes when the acid value exceeds 30.

The weight average molecular weight is 10,000 to 400,000, and preferably 20,000 to 200,000. When the weight average molecular weight is less than 10,000, an offset resistance deteriorates, which is not desirable. When it exceeds 400,000, the fixation at low temperature deteriorates, which is also undesirable.

Polyesters preferably contain urea-type denatured polyester besides native polyester obtained by the above polycondensation reaction. The urea-type denatured polyester is obtained by reaction of carboxyl group, hydroxyl group, and the like at the end of the polyester obtained by the above polycondensation reaction with a polyvalent isocyanate compound (PIC) to yield the polyester prepolymer (A) having isocyanate groups, which is then reacted with an amine compound to crosslink and/or elongate its molecular chains.

The polyvalent isocyanate compounds (PIC) include aliphatic polyvalent isocyanate (tetramethylene diisocyanate, hexamethylene diisocyanate, 2,6-diisocyanato methyl caproate, etc.); alicyclic polyisocyanate (isophorone diisocyanate, cyclohexylmethane diisocyanate, etc.); aromatic diisocyanate (tolylene diisocyanate, diphenylmethane diisocyanate, etc); aromatic aliphatic diisocyanate ($\alpha,\alpha,\alpha',\alpha'$-tetramethylxylylene diisocyanate, etc.); isocyanate compounds; the above polyisocyanates blocked with phenol derivatives, oximes, caprolactams, or the like; and a combined use of two or more of these compounds.

The ratio of the polyvalent isocyanate compound (PIC) to the native polyester is usually 5/1 to 1/1, preferably 4/1 to 1.2/1, and more preferably 2.5/1 to 1.5/1 as an equivalence ratio of [NCO]/[OH] between isocyanate group [NCO] and hydroxyl group [OH] of the polyester having hydroxyl groups. When [NCO]/[OH] exceeds 5, the fixation at low temperature deteriorates. In a case of using urea-type denatured polyester, the content of urea in its ester becomes lower when a molar ratio of [NCO] is less than 1; therefore, its hot offset resistance deteriorates.

The content of the polyvalent isocyanate (PIC) component in the polyester prepolymer (A) having isocyanate groups is usually 0.5 wt % to 40 wt %, preferably 1 wt % to 30 wt %, and more preferably 2 wt % to 20 wt %. When the content is less than 0.5 wt %, not only does the hot offset resistance deteriorate but also it becomes difficult to keep both heat resistant stability and fixation at low temperature. When it exceeds 40 wt %, the fixation at low temperature deteriorates.

The number of iscyanate groups contained in one molecule of the polyester prepolymer (A) having isocyanate groups is usually one or more, preferably an average of one and a half to three, and more preferably an average of one and one-eighth to two and a half. When the number of isocyanate groups per molecule is less than one, the molecular weight of urea-type denatured polyester becomes lower and the hot offset resistance deteriorates.

The amine compound (B) that is reacted with the polyester prepolymer (A) includes bivalent amine compounds (B1), polyvalent amine compounds that are at least trivalent (B2), amino alcohols (B3), amino mercaptans (B4), amino acids (B5), the compounds of B1 to B5 in which their amino groups are blocked (B6), and the like.

The bivalent amine compounds (B1) include aromatic diamines (phenylenediamine, diethyltoluenediamine, 4,4'-diaminodiphenylmethane, etc.); alicyclic diamine (4,4'-diamino-3,3'-dimethyldicyclohexylmethane, diaminecyclohexane, isophorone diamine, etc.); aliphatic diamines (ethylenediamine, tetramethylenediamine, hexamethylenediamine, etc.), and the like. The polyvalent amine compounds that are at least trivalent (B2) include diethylenetriamine, triethylenetetramine, and the like. The amino alcohols (B3) include ethanolamine, hydroxyethylaniline, and the like. The amino mercaptans (B4) include aminoethyl mercaptan, aminopropyl mercaptan, and the like. The amino acids (B5) include aminopropionic acid, aminocaproic acid, and the like. The compounds of B1 to B5 in which their amino groups are blocked (B6) include ketimine compounds and oxazolidine compounds that are obtained from the amine compounds of the above B1 to B5, ketone compounds (acetone, methyl ethyl ketone, methyl isobutyl ketone, etc.), and the like. Among those amine compounds (B), desirable ones are B1 and a mixture of B1 and a little amount of B2.

The ratio of amine compounds (B) to the polyester prepolymer having isocyante groups is usually 1/2 to 2/1, preferably 1.5/1 to 1/1.5, and more preferably 1.2/1 to 1/1.2 as an equivalence ratio of [NCO]/[NHx] between isocyanate group [NCO] in the polyester prepolymer (A) having isocyanate groups and amino group [NHx] in an amine compound (B). When [NCO]/[NHx] exceeds. 2 or is less than 1/2, the molecular weight of urea-type denatured polyester becomes smaller, resulting in deterioration in hot offset resistance.

Furthermore, the urea-type denatured polyester may contain urethane bonds as well as urea bonds. The molar ratio between the content of urea bonds and the content of urethane bonds is usually 100/0 to 10/90, preferably 80/20 to 20/80, and more preferably 60/40 to 30/70. When the molar ratio of the urea bonds is less than 10%, the offset hot resistance deteriorates.

The urea-type denatured polyester is produced by one-shot method or the like. A polyvalent alcohol (PO) and a polyvalent carboxylic acid (PC) are heated to 150° C. to 280° C. under the presence of a known catalyst for esterification such as tetrabutoxytitanate or dibutyltin oxide and generated water is distilled off under a reduced pressure as necessary to obtain polyester having hydroxyl groups. Next, the obtained polyester is reacted with a polyvalent isocyanate (PIC) at 40° C. to 140° C. to yield a polyester prepolymer (A) having isocyanate groups. Further, this (A) is reacted with an amine compound (B) at 0° C. to 140° C. to obtain urea-type denatured polyester.

When PIC is reacted, and when (A) and (B) are reacted with each other, solvents may be used as appropriate. The solvents that can be used include those inactives against isocyanate (PIC) such as aromatic solvents (toluene, xylene, etc.); ketone compounds (acetone, methyl ethyl ketone, methyl isobutyl ketone, etc); ester compounds (ethyl acetate, etc.); amide compounds (dimethylformamide, dimethylacetamide, etc.), and ether compounds (tetrahydrofuran, etc.).

In addition, for the reaction of one of crosslinking reaction and elongation reaction or both between a polyester prepolymer (A) and an amine compound (B), a reaction inhibitor is used as appropriate, thereby adjusting the molecular weight of the urea-type denatured polyester to be obtained. The reaction inhibitor includes monoamine (diethylamine, dibutylamine, butylamine, laurylamine, etc.), their blocked compounds (ketimine compounds), and the like.

The weight average molecular weight of the urea-type denatured polyester is usually not less than 10,000, preferably 20,000 to 10,000,000, and more preferably 30,000 to 1,000,000. When it is less than 10,000, the hot offset resistance deteriorates. The number average molecular weight of the urea-type denatured polyester and the like is not particularly limited when the native polyester described earlier is used, and a number average molecular weight that is easy to make the weight average molecular weight described earlier is accepted. When the urea-type denatured polyester is used alone, the number average molecular weight is usually 2,000 to 15,000, preferably 2,000 to 10,000, and more preferably 2,000 to 8,000. When the number average molecular weight exceeds 20,000, the fixation at low temperature deteriorates and the glossiness also deteriorates when used for full-color apparatus.

By using the combination of the native polyester and the urea-type denatured polyester, the fixation at low temperature is improved and glossiness is enhanced when used for the full-color image forming apparatus 100. Therefore, the combination is preferred to the urea-type denatured polyester used alone. The native polyester may contain other polyesters denatured by chemical bond other than urea bond.

The native polyester and the urea-type denatured polyester are preferably compatible at least partly in view of fixation at low temperature and hot offset resistance. Accordingly, the native polyester and the urea-type denatured polyester preferably have a similar composition.

Further, the weight ratio between the native polyester and the urea-type denatured polyester is usually 20/80 to 95/5, preferably 70/30 to 95/5, more preferably 75/25 to 95/5, and most preferably 80/20 to 93/7. When the weight ratio of the urea-type denatured polyester is less than 5%, not only does the hot offset resistance deteriorate but also it is difficult to keep the heat resistant stability and the fixation at low temperature at the same time.

The glass transition point (Tg) of a binding resin containing the native polyester and the urea-type denatured polyester is usually 45° C. to 65° C. and preferably 45° C. to 60° C. When the transition point is lower than 45° C., the heat resistance of the toner deteriorates, and when it exceeds 65° C., the fixation at low temperature becomes insufficient.

Furthermore, the urea-type denatured polyester tends to exist on the surface of toner base particle to be obtained. Therefore, even though the glass transition point is low compared to that of known polyester toner, a tendency of good heat resistant stability is shown.

Here, for a colorant, a charge control agent, a release agent, an external additive, and the like, the materials described earlier can be used.

Next, a production method of the toner is explained. Here, an exemplary production method is described, but the method is not limited to this.

1) A colorant, native polyester, a polyester prepolymer containing isocyanate groups and a release agent were dispersed in an organic solvent to prepare a liquid toner material.

A preferred organic solvent is volatile with a boiling point lower than 100° C. in view of ease of removal after forming toner base particles. Specifically, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, and the like can be used alone or in combination of two or more solvents. Particularly preferred are aromatic solvents such as toluene and xylene, and halogenated hydrocarbons such as methylene chloride, 1,2-dichloroethane, chloroform and carbon tetrachloride. The usage of the organic solvent is usually 0 part by weight to 300 parts by weight, preferably 0 part by weight to 100 parts by weight, and more preferably 25 parts by weight to 70 parts by weight with respect to 100 parts by weight of the polyester prepolymer.

2) The liquid toner material is emulsified in an aqueous medium under the presence of a surface active agent and fine resin particles.

The aqueous medium may be either water alone or that containing organic solvents such as alcohols (methanol, isopropyl alcohol, ethylene glycol, etc.), dimethylformamide, tetrahydrofuran, cellosolve compounds (methyl cellosolve, etc.), and lower ketone compounds (acetone, methyl ethyl ketone, etc.).

The usage of the aqueous medium with respect to 100 parts by weight of the liquid toner material is usually 50 parts by weight to 2,000 parts by weight and preferably 100 parts by weight to 1,000 parts by weight. When the usage is less than 50 parts by weight, dispersion of the liquid toner material is poor, resulting in that toner particles with a predetermined particle diameter cannot be obtained. When it exceeds 20,000 parts by weight, it is not economical.

Furthermore, to make the dispersion in the aqueous medium better, a surface-active agent and a dispersing agent such as fine resin particles are added appropriately.

The surface active agent includes anionic surfactants such as alkylbenzene sulfonate, α-olefin sulfonate, and phosphoester, amine salt-type surfactants such as alkylamine salt, fatty acid derivative of amino alcohol, fatty acid derivative of polyamine, and imidazoline, quaternary ammonium salt-type cationic surfactants such as alkyltrimethylammonium salt, dialkyldimethylammonium salt, alkyldimethylbenzylammonium salt, pyridinium salt, alkyl isoquinolinium salt, and benzethonium chloride, non-ionic surfactants such as fatty acid amide derivative and polyvalent alcohol derivative, and amphoteric surfactants, for example, alanine, dodecyldi(aminoethyl)glycine, di(octylaminoethyl)glycine, N-alkyl-N,N-dimethylammonium, and betaine.

Still further, by using a surfactant having a fluoroalkyl group, a very little amount of it makes the dispersion effective. Anionic surfactants having fluoroalkyl group that are preferably used include fluoroalkylcarboxylic acids of 2 carbon atoms to 10 carbon atoms and their metal salts, disodium perfluorooctanesulfonylglutamate, sodium 3-[ω-fluoroalkyl(C6–C11)oxy]-1-alkyl(C3–C4)sulfonates, sodium 3-[ω-fluoroalkanoyl(C6–C8)-N-ethylamino]-1-propanesulfonates, fluoroalkyl(C11–C20)carboxylic acids and their metal salts, perfluoroalkylcarboxylic acids(C7–C13) and their metal salts, perfluoroalkyl(C4–C12)sulfonic acids and their metal salts, perfluorooctanesulfonic acid diethanolamide, N-propyl-N-(2-hydroxyethyl)perfluorooctanesulfonamide, perfluoroalkyl(C6–C10)sulfonamidopropyltrimethylammonium salt, perfluoroalkyl(C6–C10)-N-ethylsulfonylglycine salt, monoperfluoroalkyl(C6–C10) ethyl phosphoric acid ester, and the like.

The commercial brands include Surflon S-111, S-112, and S-113 (products of Ashahi Glass Co., Ltd.), Fluorad FC-93, FC-95, FC-98, and FC-129 (products of Sumitomo 3M Ltd.), Unidyne DS-101 and DS-102 (products of Daikin Industries, Ltd.), Megafac F-110, F-120, F-113, F-191, F-812, and F-833 (products of Dainippon Ink and Chemicals, Inc.), EFTOP EF-102, 103, 104, 105, 112, 123A, 123B, 306A, 501, 201, and 204 (products of Tochem Products Co., Ltd.), Ftergent F-100 and F150 (products of Neos Co., Ltd), and the like.

Cationic surfactants include aliphatic primary, secondary, or tertiary amine salts having fluoroalkyl group, aliphatic quaternary ammonium salts such as perfluoroalkyl(C6–C10) sulfonamidopropyltrimethylammonium salt, benzalkonium salt, benzethonium chloride, pyridinium salt, imidazolinium salt, and commercial brands include Surflon S-121 (product of Asahi Glass Co., Ltd.), Fluorad FC-135 (product of Sumitomo 3M Ltd.), Unidyne DS-202 (product of Daikin Industries, Ltd.), Megafac F-150 and F-824 (products of Dainippon Ink and Chemicals, Inc.), EFTOP EF-132 (product of Tochem Products Co., Ltd.), Ftergent F-300 (product of Neos Co., Ltd.), and the like.

The fine resin particles are added to stabilize the toner base particle to be formed in the aqueous medium. To achieve the stabilization, the fine resin particles are preferably added to allow their surface coverage of the toner base particle to be in the range of 10% to 90%. The fine resin particles are, for example, fine particles of poly(methyl methacrylate) of 1 micrometer and 3 micrometers, fine particles of polystyrene of 0.5 micrometer and 2 micrometers, and fine particle of poly(styrene-acrylonitrile) of 1 micrometer. Their commercial names are PB-200H (product of Kao Corporation), SGP (product of Soken Chemical & Engineering Co., Ltd.), Technopolymer SB (product of Sekisui Plastics Co., Ltd.), SGP-3G (product of Soken Chemical & Engineering Co., Ltd.), Micropearl (product of Sekisui Fine Chemicals Division, Sekisui Chemical Co., Ltd.), and the like.

In addition, dispersing agents of inorganic compound such as tricalcium phosphate, calcium carbonate, titanium oxide, colloidal silica and hydroxyapatite can be used.

As a dispersing agent that is usable in combination with the above fine resin particles and dispersing agent of inorganic compound, high polymer protective colloid may be used to stabilize the dispersion droplets.

The dispersing agent that can be used includes homopolymers and copolymers of acid compounds such as acrylic acid, methacrylic acid, α-cyanoacrylic acid, α-cyanomethacrylic acid, itaconic acid, crotonic acid, fumaric acid, maleic acid, and maleic anhydride, (meth)acrylic monomers containing hydroxyl group such as acrylic acid-β-hydroxyethyl, methacrylic acid-β-hydroxyethyl, acrylic acid-β-hydroxypropyl, methacrylic acid-β-hydroxypropyl, acrylic acid-γ-hydroxypropyl, methacrylic acid-γ-hydroxypropyl, acrylic acid-3-chloro-2-hydroxypropyl, methacrylic acid-3-chloro-2-hydroxypropyl, diethylene glycol monoacrylate, diethylene glycol monomethacrylate, glycerol monoacrylate, glycerol monomethacrylate, N-methylolacrylamide, and N-methylol methacrylamide, vinyl alcohol or ether compounds with vinyl alcohol such as vinyl methyl ether, vinyl ethyl ether, and vinyl propyl ether, ester compounds of vinyl alcohol and compounds containing carboxylic group such as vinyl acetate, vinyl propionate, and vinyl butyrate, acrylamide, methacrylamide, diacetone acrylamide, or methylol compounds thereof, acid chloride compounds such as acrylic acid chloride and methacrylic acid chloride, nitrogen-containing compounds such as vinylpyridine, vinylpyrolidone, vinylimidazole, and ethyleneimine, compounds containing these heterocyclic rings and the like; polyoxyethylene-type compounds such as polyoxyethylene, polyoxypropylene, polyoxyethylene alkylamine, polyoxypropylene alkylamine, polyoxyethylene alkylamide, polyoxypropylene alkylamide, polyoxyethylene nonylphenyl ether, polyoxyethylene laurylphenyl ether, polyoxyethylene stearylphenyl ester, and polyoxyethylene nonylphenyl ester; and cellulose compounds such as methyl cellulose, hydroxyethyl cellulose and hydroxypropyl cellulose.

Although the method of dispersion is not particularly limited, known equipment such as low speed shearing system, high speed shearing system, friction system, high pressure jet system, and ultrasound equipment can be used. Among these pieces of equipment, high speed shearing system is preferable in order to make the particle diameter of the dispersing material 2 micrometers to 20 micrometers. When a dispersing machine of high speed shearing system is used, the revolution speed is not particularly limited; however, it is usually 1,000 rpm to 30,000 rpm and preferably 5,000 rpm to 20,000 rpm. The dispersion time is not particularly limited. However, when a batch system is used, the dispersion time is usually 0.1 minute to 5 minutes. The temperature at the time of dispersion is usually 0° C. to 150° C. (under pressurization) and preferably 40° C. to 98° C.

3) At the same time of preparation of emulsion, an amine compound (B) is added to react with the polyester prepolymer (A) having isocyanate groups.

This reaction accompanies one of crosslinkage and elongation or both of molecular chains. The reaction time is selected from reactivity between the structure of isocyanate group in the polyester prepolymer (A) and the amine compound (B), and it is usually 10 minutes to 40 hours and preferably 2 hours to 24 hours. The reaction temperature is usually 0° C. to 150° C. and preferably 40° C. to 98° C. In addition, a known catalyst can be used as required. Specifically, the catalyst includes dibutyltin laurate, dioctyltin laurate, and the like.

4) After the reaction, organic solvent is removed from the emulsified dispersion material (reaction product), and the obtained material is washed and dried to yield toner base particles.

To remove the organic solvent, the whole system is gradually heated in an agitation state of laminar flow, and then strongly agitated in a specific temperature range to remove the solvent, which produces spindle toner base particles. When a compound such as calcium phosphate that is soluble in acid and alkali is used as the dispersion stabilizer, calcium phosphate is removed from the toner base particles by means of washing with water and the like after dissolving calcium phosphate with an acid such as hydrochloric acid. Besides, the removal can be effected by treatment with an enzyme and the like.

5) An objective toner can be obtained by inserting charge control agents into the toner base particles obtained as above, followed by external addition of inorganic fine particles such as silica fine particles or titanium oxide fine particles.

At the time of preparation of a developer by adding an external additive and a lubricant, these may be added at the same time or added individually to mix. A general mixer for powder is used to mix the external additive and the like, and it is preferred to adjust the temperature inside the mixer by providing a jacket and the like to the mixer. Examples of mixing equipment that can be used include V-type mixer, rocking mixer, Loedige mixer, Nauter mixer, Henschel mixer, and the like. By varying mixing conditions such as revolution speed, rolling speed, time, and temperature, it is desirable to prevent the external additive from being embedded and a thin film of the lubricant from being formed on the surface of the toner.

In this way, toner that has a small particle diameter and a sharp particle diameter distribution can be easily obtained. Moreover, it is possible to control shapes from a perfect sphere to a spindle shape by giving strong agitation in the process of removal of the organic solvent. The morphology of the surface can be controlled from a smooth shape to a shriveled shape like pickled Japanese apricot.

The toner of the present invention can be used for a two-component developer by mixing with a magnetic carrier. In this case, the concentration of the carrier and the toner in the developer is preferably from 1 part by weight to 10 parts by weight of the toner with respect to 100 parts by weight of the carrier. Further, the toner of the present invention can be used for single-component magnetic toner or non-magnetic toner without using a carrier.

Furthermore, in a process cartridge, at least the photosensitive member 5 that forms a latent image, the cleaning blade 151, the brush-shaped roller 156, and the molded lubricant 157 are arranged, the brush-shaped roller 156 is insulative and applies the lubricant of the molded lubricant 157 over the photosensitive member 5, and the cleaning unit that delivers the toner cleaned by the cleaning blade 151 to the inside of the cleaning unit 15 is integrally supported. The process cartridge is detachable from the main body of image forming apparatus 1. By virtue of this, the life of the photosensitive member 5 housed in the process cartridge can be prolonged and when maintenance is required, only the process cartridge is exchanged, which enhances convenience.

In the cleaning unit of the present invention, according to the means to solve the problems described earlier, a lubricant is applied to enhance the cleaning performance, the cleaned toner is made possible to be delivered to the inside of the cleaning unit by one brush-shaped roller, and an effect that the cleaning unit can exert stable cleaning is offered even though it is used for a long time.

With the use of the process cartridge and the image forming apparatus of the present invention, the duration of their lives can be prolonged and an effect that images of high quality without dirty background can be obtained by exerting stable cleaning is offered.

Furthermore, with the use of the toner of the present invention, an effect that the toner can be cleaned by the cleaning blade, resulting in obtainment of images with high-definition is offered.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A cleaning unit comprising:

a cleaning blade that cleans toner on an image carrier; and a brush-shaped roller that applies a lubricant of a molded lubricant on the image carrier, wherein the brush-shaped roller is insulative, and delivers the toner cleaned by the cleaning blade to inside of the cleaning unit wherein an electrical resistivity of the brush-shaped roller is $10^{12}$ Ω•cm or more.

2. The cleaning unit according to claim 1, wherein the brush-shaped roller is made of a polyamide resin or a polyester resin.

3. The cleaning unit according to claim 1, wherein the molded lubricant is formed of fluoride resin particles or a metallic salt of fatty acid.

4. The cleaning unit according to claim 1, wherein a scraper that scrapes the toner adhering to the brush-shaped roller is arranged on a downstream side of the molded lubricant with respect to a direction of rotation of the brush-shaped roller.

5. A process cartridge comprising:

an image carrier that carries a latent image; and a cleaning unit that cleans toner on the image carrier, wherein the process cartridge is detachably arranged in a main body of an image forming apparatus, the cleaning unit includes a cleaning blade, a brush-shaped roller, and a molded lubricant, and the brush-shaped roller is insulative, applies a lubricant of the molded lubricant on the image carrier, and delivers the toner cleaned by the cleaning blade to inside of the cleaning unit wherein an electrical resistivity of the brush-shaped roller is $10^{12}$ Ω·cm or more.

6. The process cartridge according to claim 5, wherein the brush-shaped roller is made of a polyamide resin or a polyester resin.

7. The process cartridge according to claim 5, wherein the molded lubricant is formed of fluoride resin particles or a metallic salt of fatty acid.

8. The process cartridge according to claim 5, wherein a scraper that scrapes the toner adhering to the brush-shaped roller is arranged on a downstream side of the molded lubricant with respect to a direction of rotation of the brush-shaped roller.

9. An image forming apparatus comprising:

an image carrier that carries a latent image;

a charging unit that charges the image carrier by bringing a charging member to come in contact with or to come close to a surface of the image carrier;

a latent-image forming unit that forms a latent image on the image carrier;

a developing unit that develops the latent image by bringing toner to adhere to the latent image to form a toner image;

a transfer unit that transfers the toner image formed on the image carrier to a recording medium moving tightly held between a surface of the image carrier and a surface moving member or to the surface moving member by forming a transfer electric field between the image carrier and the surface moving member that moves in contact with the surface of the image carrier; and a cleaning unit that cleans toner on the image carrier, wherein the cleaning unit includes a cleaning blade, a brush-shaped roller, and a molded lubricant, and the brush-shaped roller is insulative, applies a lubricant of the molded lubricant on the image carrier, and delivers the toner cleaned by the cleaning blade to inside of the cleaning unit wherein an electrical resistivity of the brush-shaped roller is $10^{12}$ Ω·cm or more.

10. The image forming apparatus according to claim 9, wherein the brush-shaped roller is made of a polyamide resin or a polyester resin.

11. The image forming apparatus according to claim 9, wherein the molded lubricant is formed of fluoride resin particles or a metallic salt of fatty acid.

12. The image forming apparatus according to claim 9, wherein a scraper that scrapes the toner adhering to the brush-shaped roller is arranged on a downstream side of the molded lubricant with respect to a direction of rotation of the brush-shaped roller.

13. The image forming apparatus according to claim 9, wherein the charging member is in a roller shape, and the charging unit includes a driving member that drives the charging member.

14. The image forming apparatus according to claim 9, wherein the toner has a volume average particle diameter in a range of 3 micrometers to 8 micrometers and a degree of dispersion defined by a ratio of a volume average particle diameter to a number average particle diameter is in a range of 1.00 to 1.40.

15. The image forming apparatus according to claim 14, wherein an average spheroidicity of the toner is in a range of 0.93 to 1.00.

16. The image forming apparatus according to claim 14, wherein both a shape fraction SF-1 and a shape fraction SF-2 of the toner are in a range of 100 to 180.

17. The image forming apparatus according to claim 14, wherein a shape of external appearance of the toner is nearly spherical, a ratio of a minor axis r2 to a major axis r1 is in a range of 0.5 to 1.0, a ratio of a thickness r3 to the minor axis r2 is in a range of 0.7 to 1.0, and $r1 \geqq r2 \geqq r3$ is satisfied.

18. The image forming apparatus according to claim 14, wherein, the toner is formed by at least crosslinking reaction and elongation reaction of toner components that contain at least a polyester prepolymer having functional groups containing nitrogen, a polyester, a colorant, and a release agent in an aqueous medium in the presence of fine resin particles.

19. An image forming apparatus comprising:

an image carrier that carries a latent image;

a charging unit that charges the image carrier by bringing a charging member to come in contact with or to come close to a surface of the image carrier;

a latent-image forming unit that forms a latent image on the image carrier;

a developing unit that develops the latent image by bringing toner to adhere to the latent image to form a toner image;

a transfer unit that transfers the toner image formed on the image carrier to a recording medium moving tightly held between a surface of the image carrier and a surface moving member or to the surface moving member by forming a transfer electric field between the image carrier and the surface moving member that moves in contact with the surface of the image carrier; and a cleaning unit that cleans toner on the image carrier, wherein the cleaning unit includes a cleaning blade, a brush-shaped roller, and a molded lubricant, the brush-shaped roller is insulative, applies a lubricant of the molded lubricant on the image carrier, and delivers the toner cleaned by the cleaning blade to inside of the cleaning unit wherein an electrical resistivity of the brush-shaped roller is $10^{12}$ Ω·cm or more, a volume average particle diameter of the toner is in a range of 3 micrometers to 8 micrometers, and a degree of dispersion of the toner defined by a ratio of a volume average particle diameter to a number average particle diameter is in a range of 1.00 to 1.40.

20. The image forming apparatus according to claim 19, wherein the brush-shaped roller is made of a polyamide resin or a polyester resin.

21. The image forming apparatus according to claim 19, wherein the molded lubricant is formed of fluoride resin particles or a metallic salt of fatty acid.

22. The image forming apparatus according to claim 19, wherein a scraper that scrapes the toner adhering to the brush-shaped roller is arranged on a downstream side of the molded lubricant with respect to a direction of rotation of the brush-shaped roller.

* * * * *